US007845728B2

(12) United States Patent
Chen et al.

(10) Patent No.: US 7,845,728 B2
(45) Date of Patent: Dec. 7, 2010

(54) INFANT ROCKING CHAIR AND DRIVING DEVICE FOR DRIVING THE SAME

(75) Inventors: Shun-Min Chen, Taipei (TW); Jun-Xu Jin, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/819,643

(22) Filed: Jun. 28, 2007

(65) Prior Publication Data

US 2008/0179928 A1 Jul. 31, 2008

(30) Foreign Application Priority Data

Jan. 26, 2007 (CN) ..... 2007 2 0002699 U

(51) Int. Cl.
*A47D 13/10* (2006.01)
*A63G 13/00* (2006.01)

(52) U.S. Cl. ..... 297/274; 297/260.1; 297/260.2; 297/261.1; 297/261.2; 472/97; 472/135

(58) Field of Classification Search ..... 297/260.2, 297/260.1, 261.2, 261.3, 261.1, 274, 275; 472/95, 96, 97, 47, 135; 5/108, 109; 601/97, 601/98, 101; 600/26; 248/415, 157, 519, 248/521

See application file for complete search history.

(56) References Cited

U.S. PATENT DOCUMENTS 3,210,076 A * 10/1965 Walker ..... 472/97
4,258,446 A * 3/1981 McAllister et al. ..... 5/109
5,085,425 A * 2/1992 Collins et al. ..... 472/97
5,183,457 A * 2/1993 Gatts et al. ..... 600/21
5,303,433 A * 4/1994 Jang ..... 5/109
5,711,045 A * 1/1998 Caster et al. ..... 5/109
6,505,361 B1 * 1/2003 Ogawa ..... 5/109
6,519,792 B2 * 2/2003 Chen ..... 5/109
2002/0113469 A1 * 8/2002 Stern et al. ..... 297/256.16
2002/0140263 A1 * 10/2002 Sato et al. ..... 297/260.1
2007/0007804 A1 * 1/2007 Pemberton et al. ..... 297/260.2
2007/0129596 A1 * 6/2007 Dickie ..... 600/26
2007/0205646 A1 * 9/2007 Bapst et al. ..... 297/261.1

* cited by examiner

*Primary Examiner*—Rodney B White
*Assistant Examiner*—James Alex
(74) *Attorney, Agent, or Firm*—Pillsbury Winthrop Shaw Pittman, LLP

(57) ABSTRACT

A driving device is adapted for an infant rocking chair. The rocking chair includes a seat body and a bottom seat. The driving device includes a base, a supporting element, first and second motion mechanisms, and a power mechanism. The first motion mechanism includes a horizontal first guide path unit disposed at the bottom seat, and a first movable member disposed on the base and movable along the first guide path unit. The second motion mechanism includes a vertically varying second guide path unit disposed at the bottom seat, and a second movable member movable along the second guide path unit and vertically relative to the base. The supporting element interconnects fixedly the seat body and the second movable member. The power mechanism drives reciprocal movement of the first and second movable members.

3 Claims, 16 Drawing Sheets

INFANT ROCKING CHAIR AND DRIVING DEVICE FOR DRIVING THE SAME

CROSS-REFERENCE TO RELATED APPLICATION

This application claims priority of Chinese Application No. 200720002699.0, filed on Jan. 26, 2007.

BACKGROUND OF THE INVENTION

1. Field of the Invention

This invention relates to an infant rocking chair, and more particularly to a driving device for driving a seat body of an infant rocking chair to move back and forth as well as up and down.

2. Description of the Related Art

Conventional infant rocking chairs can only produce either only a back-and-forth motion or an up-and-down motion. However, a curved swinging motion in which a back-and-forth motion is combined with an up-and-down motion so as to simulate the motion usually made by a person taking care of and holding an infant in his or her arms, is able to impart greater comfort to the infant. Furthermore, conventional driving devices for driving infant rocking chairs include interconnected gears, which generate a large amount of noise during operation.

SUMMARY OF THE INVENTION

An object of this invention is to provide a driving device for driving a seat body of an infant rocking chair to reciprocate back and forth as well as up and down in such a manner that only little noise is generated, thereby resulting in infant comfort.

Another object of this invention is to provide a rocking chair that includes a seat body, which can be operated selectively in a back-and-forth motion or a curved swinging motion.

According to an aspect of this invention, a driving device for an infant rocking chair is provided. The infant rocking chair includes a seat body and a bottom seat. The driving device is adapted to drive the seat body to reciprocate relative to the bottom seat back and forth as well as up and down, and comprises:

a base adapted to be disposed between the seat body and the bottom seat;

a supporting element extending through the base and having a top end adapted to be connected to the seat body;

a first motion mechanism including a horizontal first guide path unit disposed at the bottom seat, and a first movable member disposed on the base and movable along the first guide path unit; and a second motion mechanism including a vertically varying second guide path unit disposed at the bottom seat, and a second movable member disposed fixedly on a bottom end of the supporting element and movable along the second guide path unit.

According to another aspect of this invention, an infant rocking chair comprises:

a seat body;

a bottom seat;

a base adapted to be disposed between the seat body and the bottom seat;

a supporting element mounted movably on the base and having a top end adapted to be connected to the seat body;

a first motion mechanism including a first guide path unit disposed at the bottom seat, and a first movable member disposed on the base and movable along the first guide path unit; and a second motion mechanism including a second guide path unit disposed at the bottom seat, and a second movable member disposed fixedly on a bottom end of the supporting element and movable along the second guide path unit;

wherein, when the base is moved back and forth relative to the bottom seat along the first guide path unit, an assembly of the seat body and the supporting element is moved up and down relative to the base.

According to still another aspect of this invention, an infant rocking chair comprising:

a seat body;

a bottom seat;

a supporting element having a top end adapted to be connected to the seat body;

a base adapted to be disposed between the seat body and the bottom seat and including a mounting member permitting the supporting element to be mounted movably thereon, and a locking unit for locking the supporting element relative to the mounting member;

a first motion mechanism including a first guide path unit disposed at the bottom seat, and a first movable member disposed on the base and movable along the first guide path unit so that the seat body is movable relative to the bottom seat in a first direction;

a second motion mechanism including a second guide path unit disposed at the bottom seat, and a second movable member disposed fixedly on a bottom end of the supporting element and movable along the second guide path unit so that the seat body is movable relative to the base in a second direction different from the first direction; and a power mechanism for driving the base to reciprocate relative to the bottom seat along the first guide path unit in the first direction;

the supporting element and the locking unit being operable so as to convert the supporting element between a released state where the second movable member is in contact with the second guide path unit so as to allow the seat body to move relative to the base in the second direction when the base is moved relative to the bottom seat in the first direction, and a locked state where the second movable member is removed from the second guide path unit so as to allow the seat body to move relative to the bottom seat in only the first direction.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
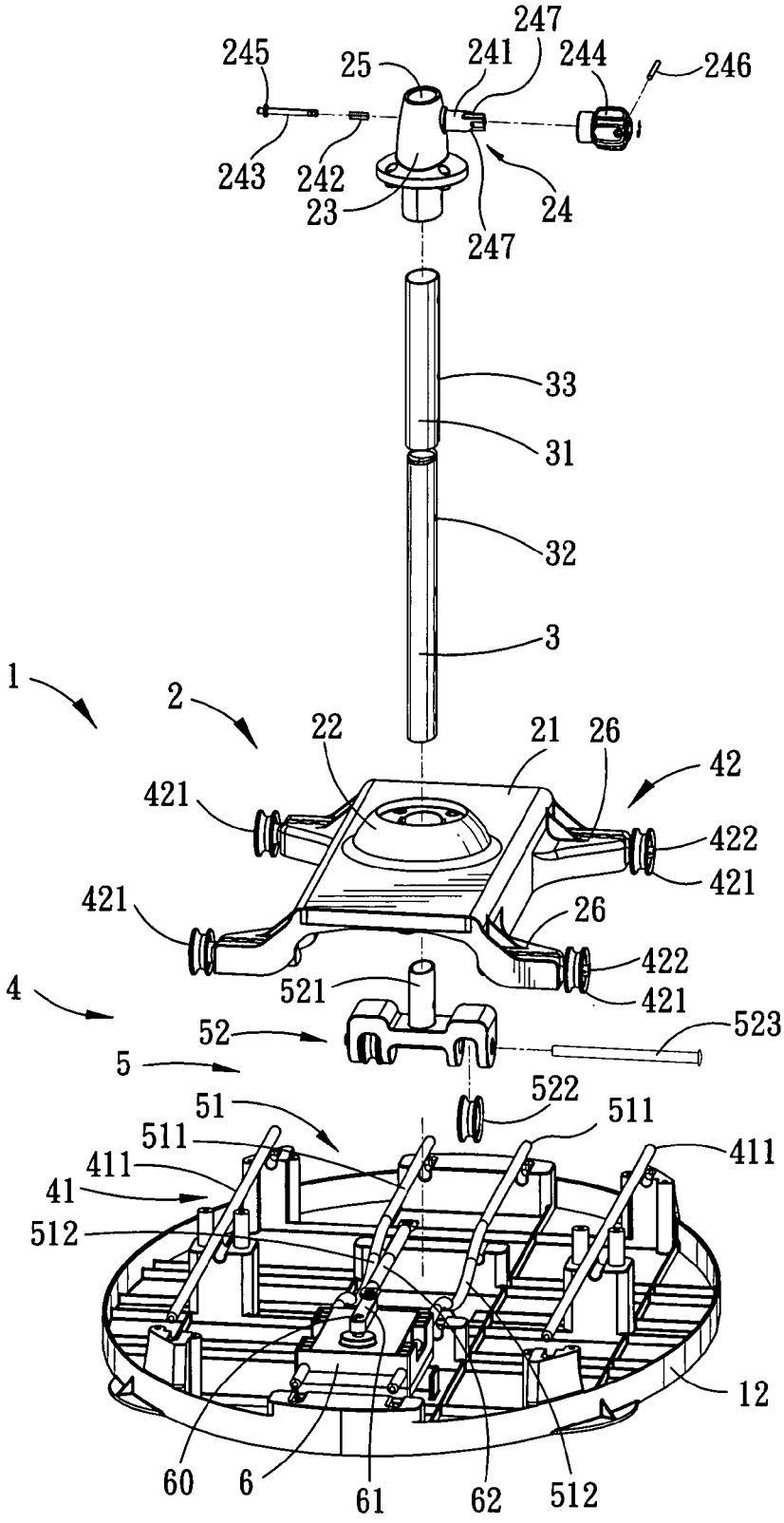
FIG. 1 is a partly exploded perspective view of the first preferred embodiment of a driving device for driving an infant rocking chair according to this invention.

Before the present invention is described in greater detail in connection with the preferred embodiments, it should be noted that similar elements and structures are designated by like reference numerals throughout the entire disclosure.

Figure 2:
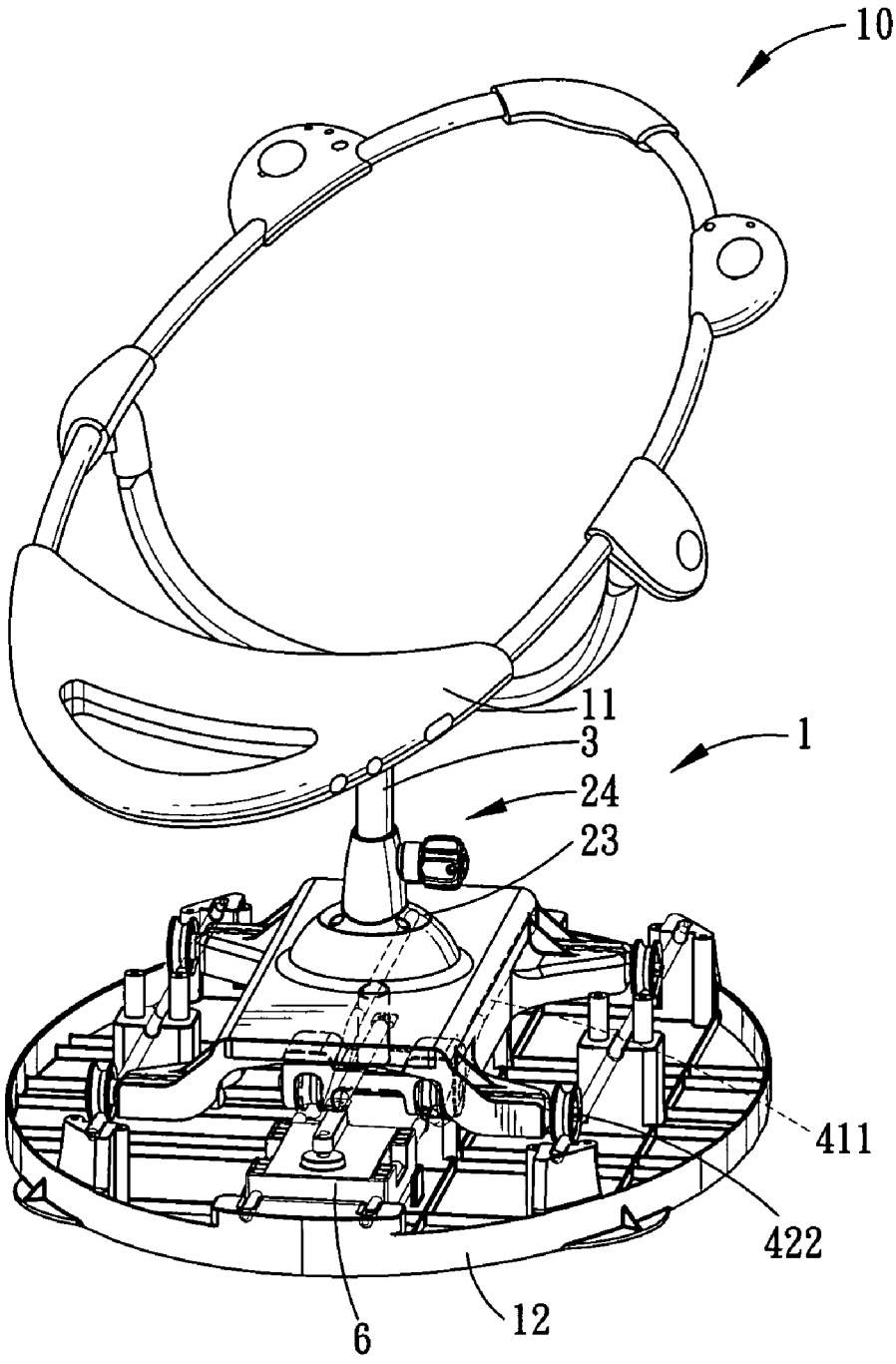
FIG. 2 is an assembled perspective view of the first preferred embodiment.

FIGS. 1 and 2 show the first preferred embodiment of a driving device 1 for an infant rocking chair 10 according to this invention. The infant rocking chair 10 includes a seat body 11 and a bottom seat 12. The driving device 1 drives the seat body 11 to reciprocate relative to the bottom seat 12 back and forth as well as up and down. The driving device 1 includes a base 2, an upright supporting rod 3 having a top end connected to the seat body 11, a sleeve tube 31 sleeved around the supporting rod 3 so as to allow for synchronous horizontal movement of the supporting rod 3 and the base 2, first and second motion mechanisms 4, 5, and a power mechanism 6.

The base 2 is disposed between the seat body 11 and the bottom seat 12, and includes a substantially rectangular plate 21, a frustoconical connecting member 22 disposed fixedly on and above a central portion of the plate 21, a tubular rod-mounting member 23 inserted into and connected fixedly to the connecting member 22, and a locking unit 24. The rod-mounting member 23 is formed with a central bore 25 therethrough. The sleeve tube 31 is inserted into and connected fixedly to the rod-mounting member 23. The supporting rod 3 is movable axially within the sleeve tube 31. The supporting rod 3 and the sleeve tube 31 are formed respectively with two aligned holes 32, 33.

Figure 1A:
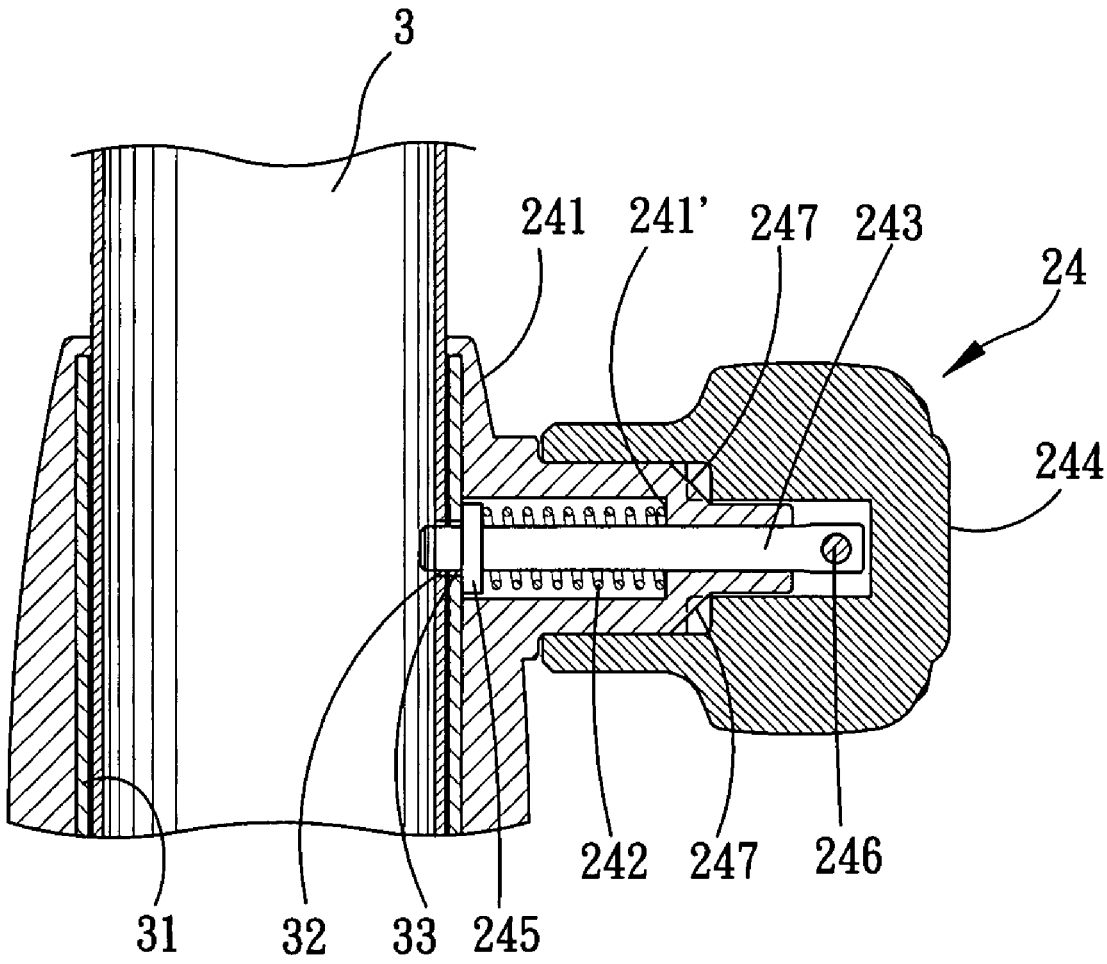
FIG. 1A is a fragmentary side view of the first preferred embodiment, illustrating a locking unit.

With further reference to FIG. 1A, the locking unit 24 includes a spring-accommodating portion 241 extending laterally from the rod-mounting member 23 and in spatial communication with the central bore 25 in the rod-mounting member 23, a coiled compression spring 242 disposed within the spring-accommodating portion 241, a movable pin 243, and a rotary knob 244 sleeved on a right end of the spring-accommodating portion 241. The movable pin 243 extends through spring-accommodating portion 241 and the spring 242 and into the rotary knob 244, and is aligned with the hole 33 in the sleeve tube 31. A flange 245 extends radially and outwardly from a left end portion of the movable pin 243. The coil compression spring 242 is disposed between the flange 245 and a shoulder 241' of the spring-accommodating portion 241. A fastening pin 246 extends through a right end of the movable pin 243, and is connected fixedly to the rotary knob 244 so as to allow for synchronous movement and rotation of the movable pin 243 and the rotary knob 244. As such, the rotary knob 244 is biased by the spring 242 to move on the spring-accommodating portion 241 toward the rod-mounting member 23. Thus, when the supporting rod 3 is moved within the sleeve tube 31 to a predetermined axial position shown in FIG. 1A to thereby align the hole 32 in the supporting rod 3 with the hole 33 in the sleeve tube 31, the left end portion of the movable pin 243 is urged by the spring 242 into the holes 32, 33 in the supporting rod 3 and the sleeve tube 31. As a result, the supporting rod 3 is locked within the sleeve tube 31 at the predetermined axial position. In other words, the supporting rod 3 is maintained in a locked state.

Each of the spring-accommodating portion 241 and the rotary knob 244 is formed with two inclined guiding surfaces 247 at two opposite side portions thereof. The inclined guiding surfaces 247 of the spring-accommodating portion 241 abut respectively against the inclined guiding surfaces 247 of the rotary knob 244 such that, when a force is applied to the rotary knob 244 for rotating the same in a direction, the rotary knob 244 moves away from the spring-accommodating portion 241 to thereby remove the movable pin 243 from the holes 32, 33. Hence, the supporting rod 3 is movable within the sleeve tube 31. In other words, the supporting rod 3 is converted into a released state. When the force is released, the left end portion of the movable pin 243 is biased by the spring 242 to contact an annular wall surface of the supporting rod 3.

The first motion mechanism 4 includes a horizontal first guide path unit 41 and a first movable member 42 movable along the first guide path unit 41. The first guide path unit 41 includes a pair of spaced-apart straight guiding rods 411 disposed on and above the bottom seat 12. The first movable member 42 includes two parallel rows of first rollers 421 disposed respectively on two opposite sides of the base 2 and movable respectively along the straight guiding rods 411. In this embodiment, each of the first rollers 421 is sleeved rotatably on an axle 422. The axles 422 are connected respectively to four supporting legs 26 extending respectively and integrally from four corners of the plate 21.

The second motion mechanism 5 includes a vertically varying second guide path unit 51 and a second movable member 52 movable along the second guide path unit 51 when the supporting rod 3 is in the released state. The second guide path unit 51 includes a pair of vertically curved guiding rods 511 parallel to and spaced apart from each other along a horizontal direction. Each of the curved guiding rods 511 has a sunken rod segment 512 at a middle portion thereof. The second movable member 52 includes a supporting frame 521 attached fixedly to a bottom end of the supporting rod 3, and a pair of second rollers 522. The second rollers 522 are sleeved rotatably on an axle 523 connected fixedly to the supporting frame 521. When the supporting rod 3 is converted from the locked state into the released state, it moves downwardly within the sleeve tube 31 by gravity until the second rollers 522 come into contact with the curved guiding rods 511, respectively, as shown in FIGS. 3 and 5.

The power mechanism 6 is configured as a variable speed motor including a vertical motor shaft 60. The driving device 1 further includes a crank 61 connected fixedly to the motor shaft 60 at one end thereof, and a link 62 having two ends connected respectively and pivotally to the base 2 and the other end of the crank 61. As such, rotation of the motor shaft 60 results in reciprocal movement of the first and second movable members 42, 52. Due to the presence of the crank 61 and the link 62 interconnected between the power mechanism 6 and an assembly of the first and second movable members 42, 52, the power mechanism 6 is capable of driving the first movable member 42 and, thus, the base 2 to reciprocate back and forth along the first guide path unit 41, and of driving the second movable member 52 along the second guide path unit 51 so as to allow an assembly of the supporting rod 3 and the seat body 11 to reciprocate up and down relative to the base 2.

Figure 4:
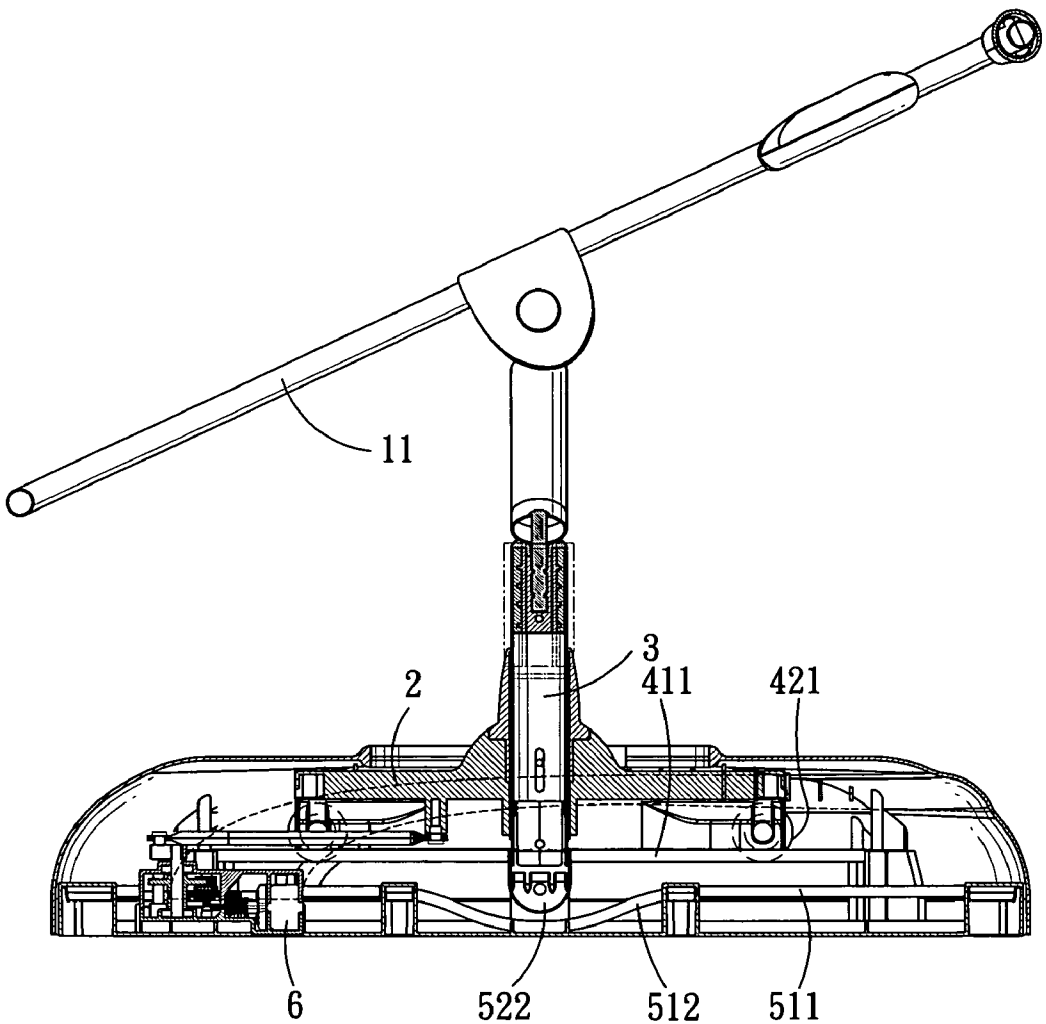

With particular reference to FIG. 4, when the supporting rod 3 is in the locked state and when the power mechanism 6 is operated, the second rollers 522 are spaced respectively apart from the curved guiding rods 511. This prevents movement of the seat body 11 relative to the base 2, thereby resulting in only a back-and-forth motion of the seat body 11.

Figure 3:
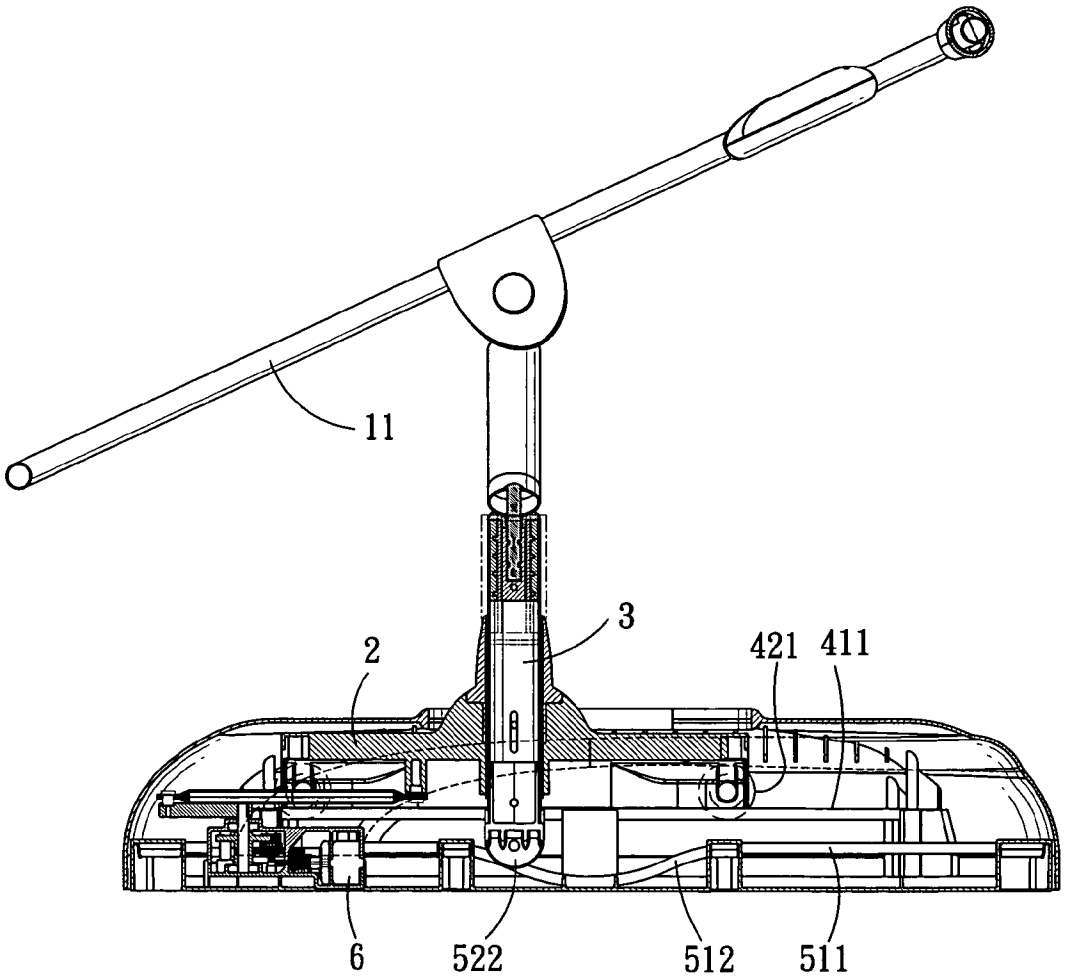
FIGS. 3, 4, and 5 are schematic partly sectional views of the first preferred embodiment, illustrating the reciprocal movements of first and second movable members.
Figure 5:
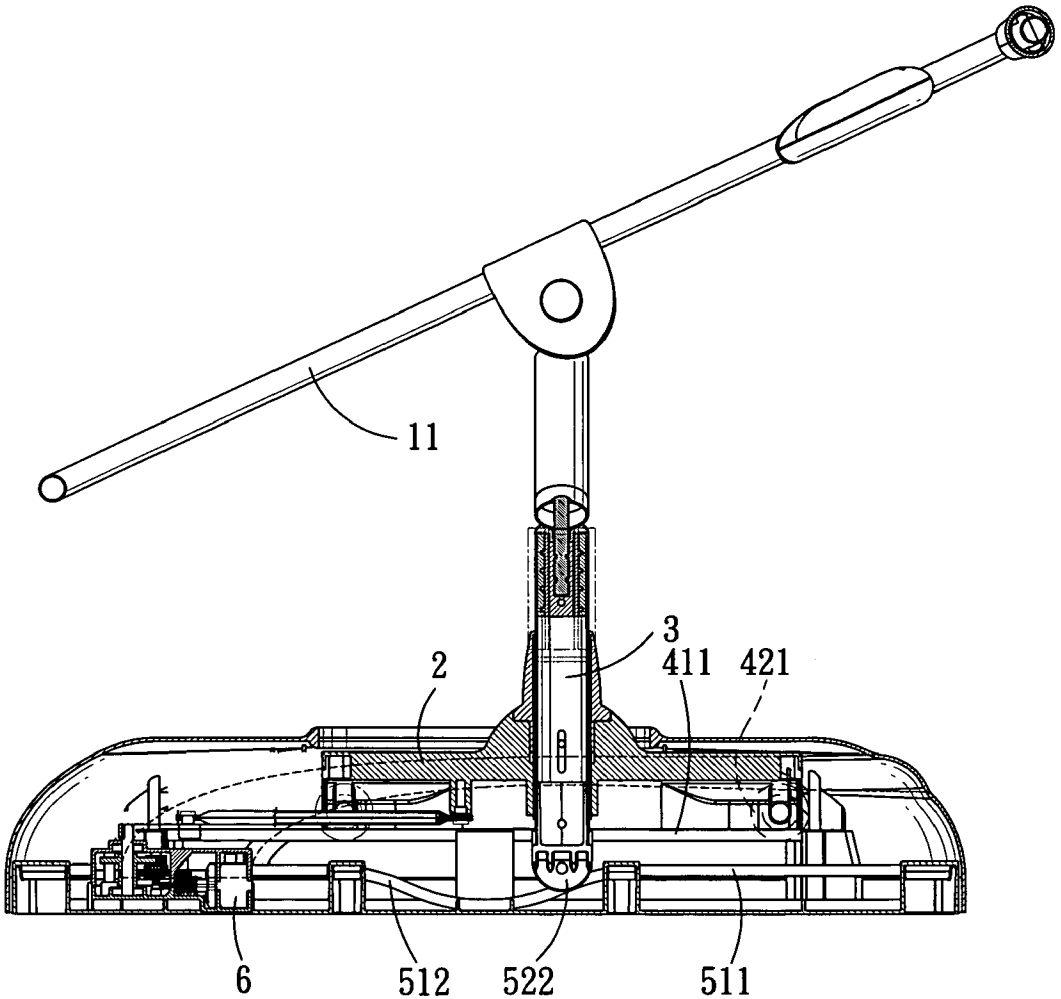

With particular reference to FIGS. 3 and 5, when the supporting rod 3 is in the released state and when the power mechanism 6 is operated, the second rollers 522 are in contact with the curved guiding rods 511, respectively. This allows for movement of the seat body 11 relative to the base 2, thereby resulting in a curved swinging motion of the seat body 11 in which the back-and-forth motion is combined with an up-and-down motion so as to simulate the motion usually made by a person taking care of and holding an infant in his or her arms.

Figure 6:
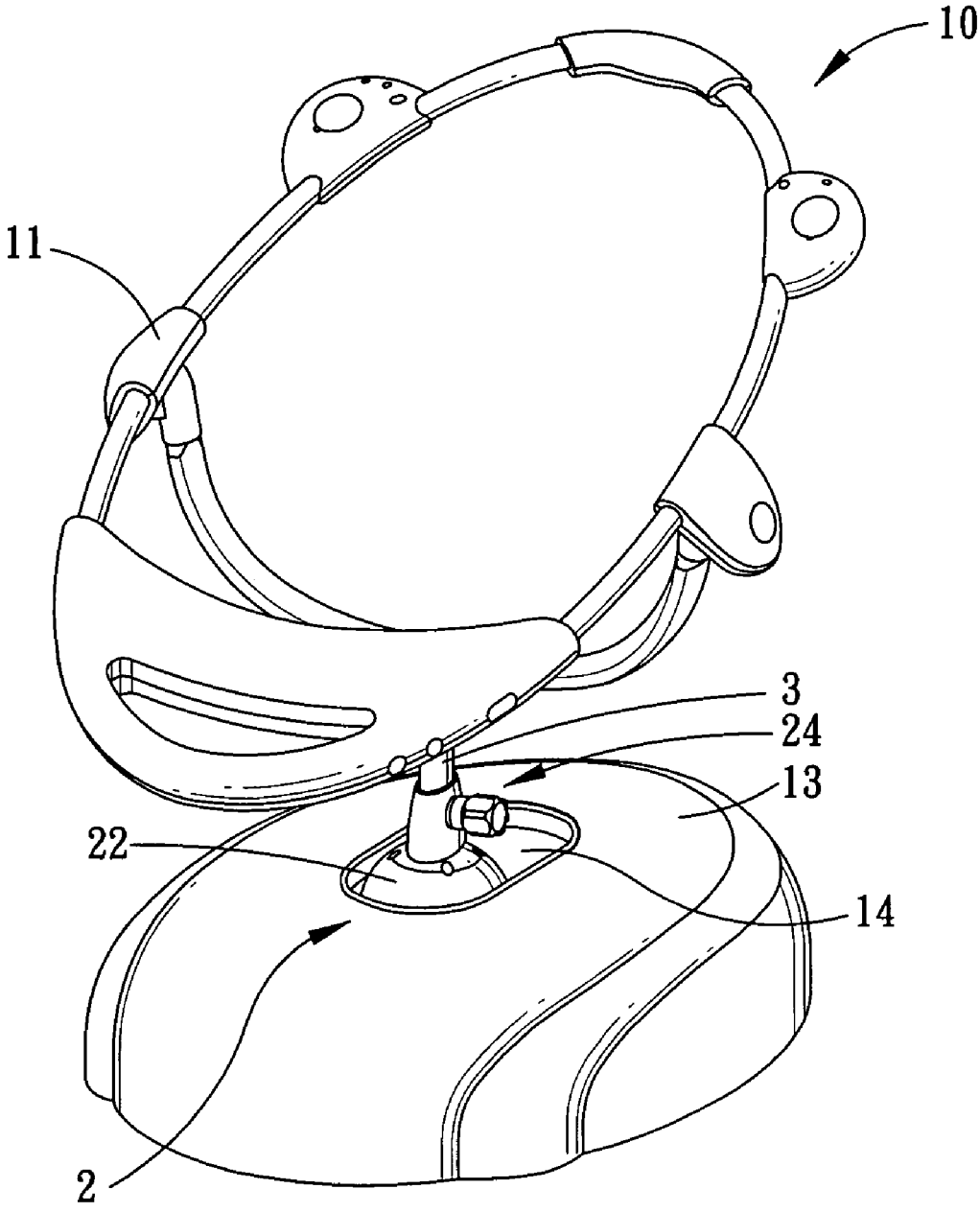
FIG. 6 is a perspective view of the infant rocking chair including the first preferred embodiment.

FIG. 6 shows the infant rocking chair 10 configured to further include a cover body 13. The cover body 13 cooperates with the bottom seat 12 (see FIG. 1) so as to define an accommodating chamber 14 therebetween. The driving device 1 (see FIG. 1) is disposed within the accommodating chamber 14 such that the base 2 and the supporting rod 3 extend partially and upwardly from the cover body 13.

FIGS. 7, 8, 9, and 10 show the second preferred embodiment of a driving device for an infant rocking chair according to this invention, which is similar in construction to the first preferred embodiment. In this embodiment, a threaded rod 7 is added, and the curved guiding rods 511 (see FIG. 1), the crank 61 (see FIG. 1), and the link 62 (see FIG. 1) are omitted. The threaded rod 7 is disposed between the bottom seat 12 and the base 2, and is rotatable by the power mechanism 6. The threaded rod 7 has two end portions disposed respectively and rotatably on the bottom seat 12 by two supporting units 73, and an annular outer surface formed with an annular first helical slot 71 having a variable depth, and an annular second helical slot 72 having a uniform depth. The first helical slot 71 constitutes the second guide path unit. The supporting rod 3 is formed with a first projecting tooth 91 that extends from a bottom end thereof into the first helical slot 71 and that constitutes the second movable member. The base 2 is formed with a second projecting tooth 27 that extends downwardly therefrom into the second helical slot 72.

The first motion mechanism 8 includes the straight guiding rods 81 and the first rollers 82. When the threaded rod 7 is rotated by the power mechanism 6, the second projecting tooth 27 of the base 2 is moved along the second helical slot 72. Hence, the first rollers 82 reciprocate along the straight guiding rods 81, thereby resulting in a back-and-forth motion of the base 2 relative to the bottom seat 12.

The second motion mechanism 9 includes the first helical slot 71 and the first projecting tooth 91. When the first projecting tooth 91 is moved along the first helical slot 71, the supporting rod 3 reciprocates up and down relative to the base 21.

When the supporting rod 3 is in the locked state and when the power mechanism 6 is operated, the first projecting tooth 91 is spaced apart from the first helical slot 71. This prevents movement of the seat body 11 relative to the base 2, thereby resulting in only a back-and-forth motion of the seat body 11.

When the supporting rod 3 is in the released state and when the power mechanism 6 is operated, the first projecting tooth 91 comes into contact with the threaded rod 7, and slides along the first helical slot 71 in the threaded rod 7. This allows for movement of the seat body 11 relative to the base 2, thereby resulting in a curved swinging motion of the seat body 11.

Figure 7:
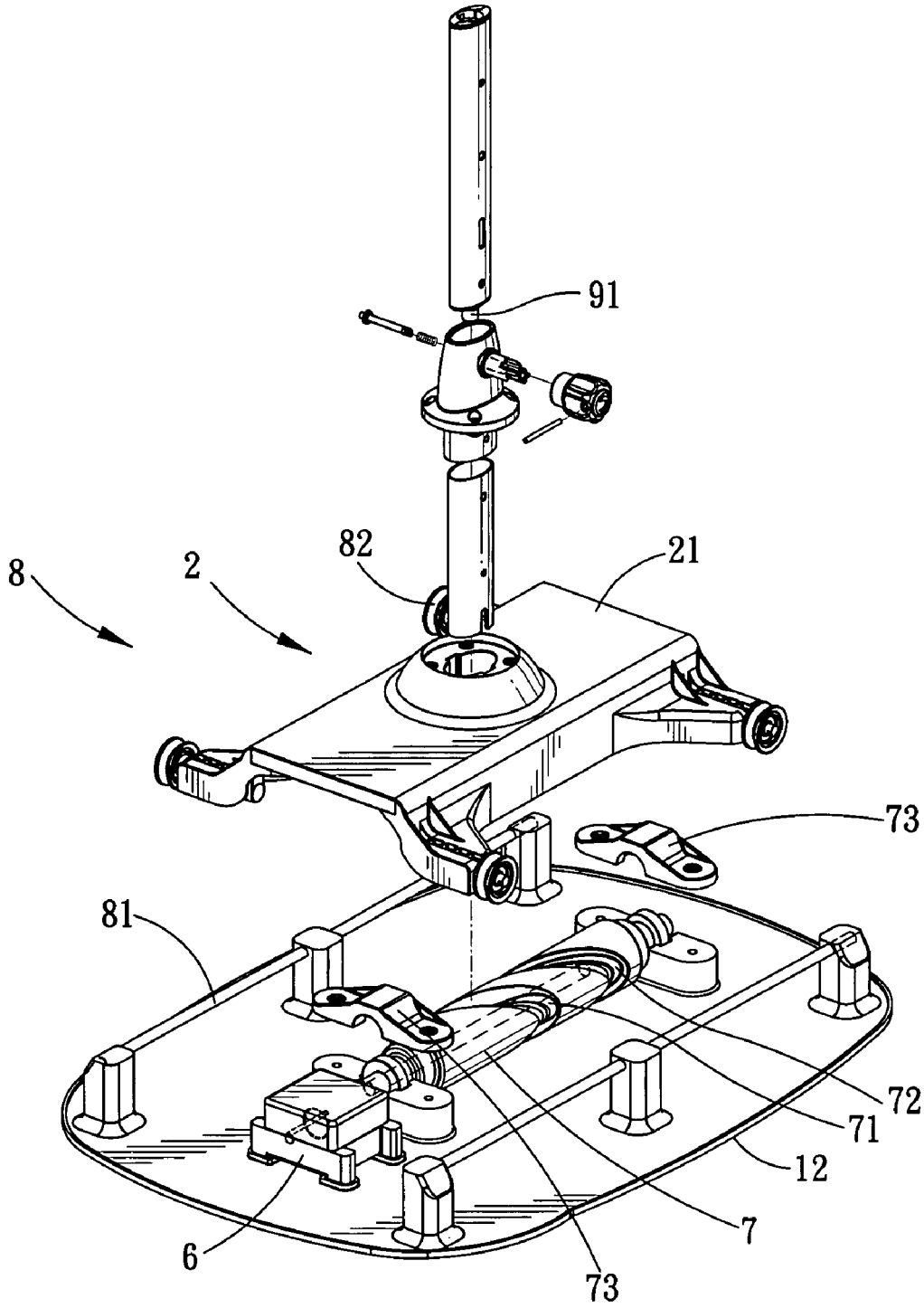
FIG. 7 is a partly exploded perspective view of the second preferred embodiment of a driving device for an infant rocking chair according to this invention.
Figure 8:
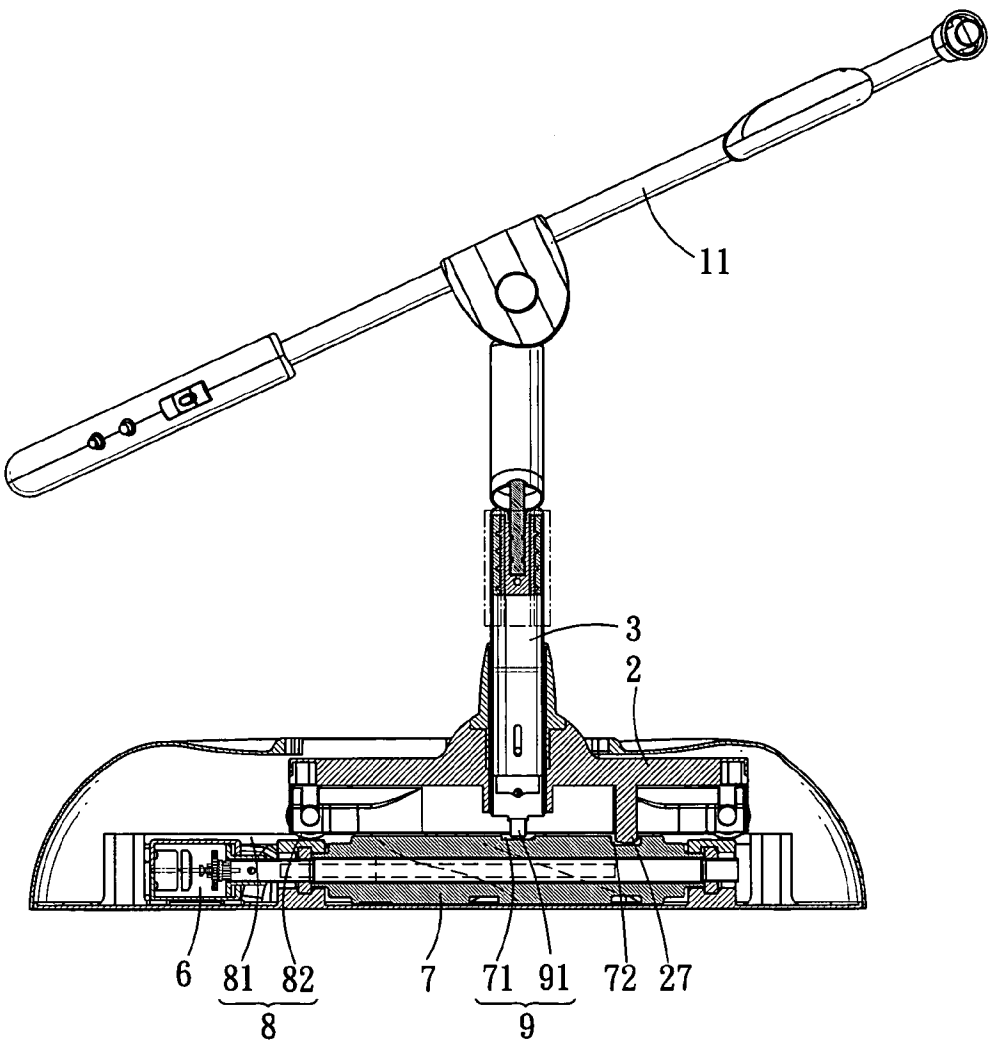
FIGS. 8, 9, and 10 are schematic partly sectional views of the second preferred embodiment, illustrating the reciprocal movements of first and second movable members.
Figure 9:
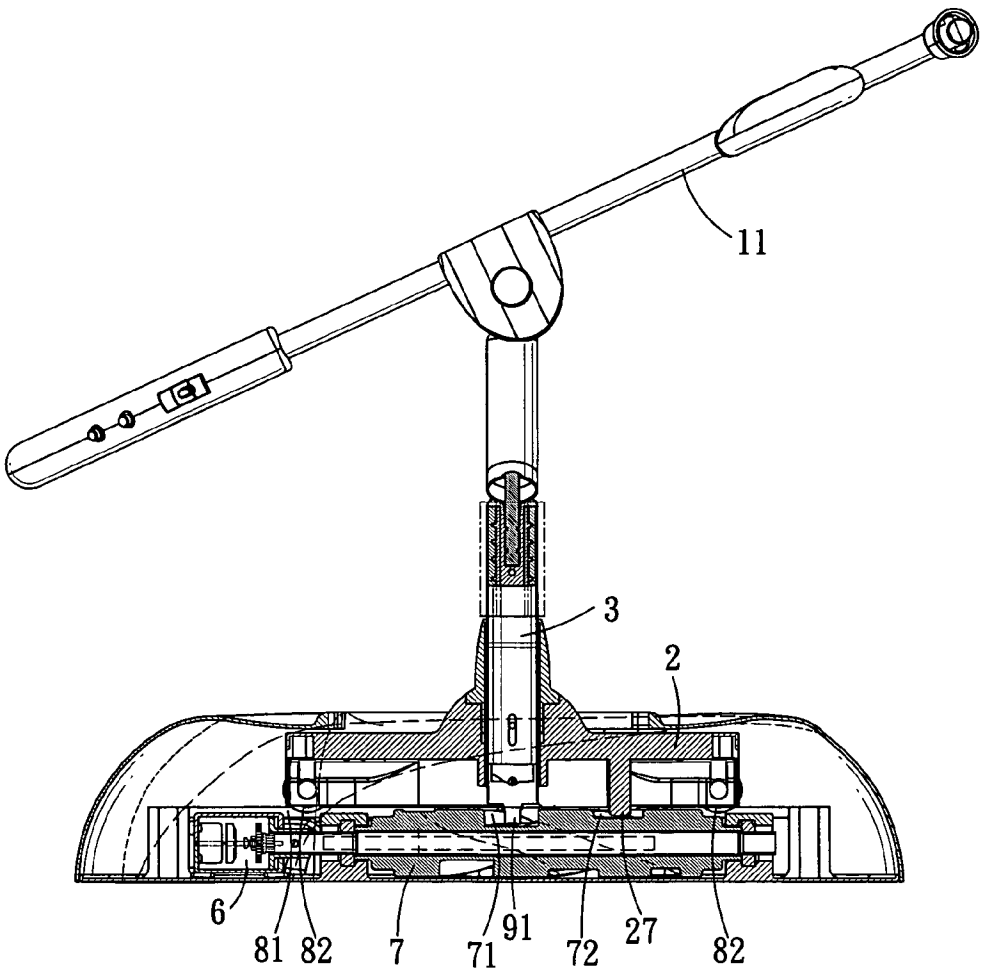
Figure 10:
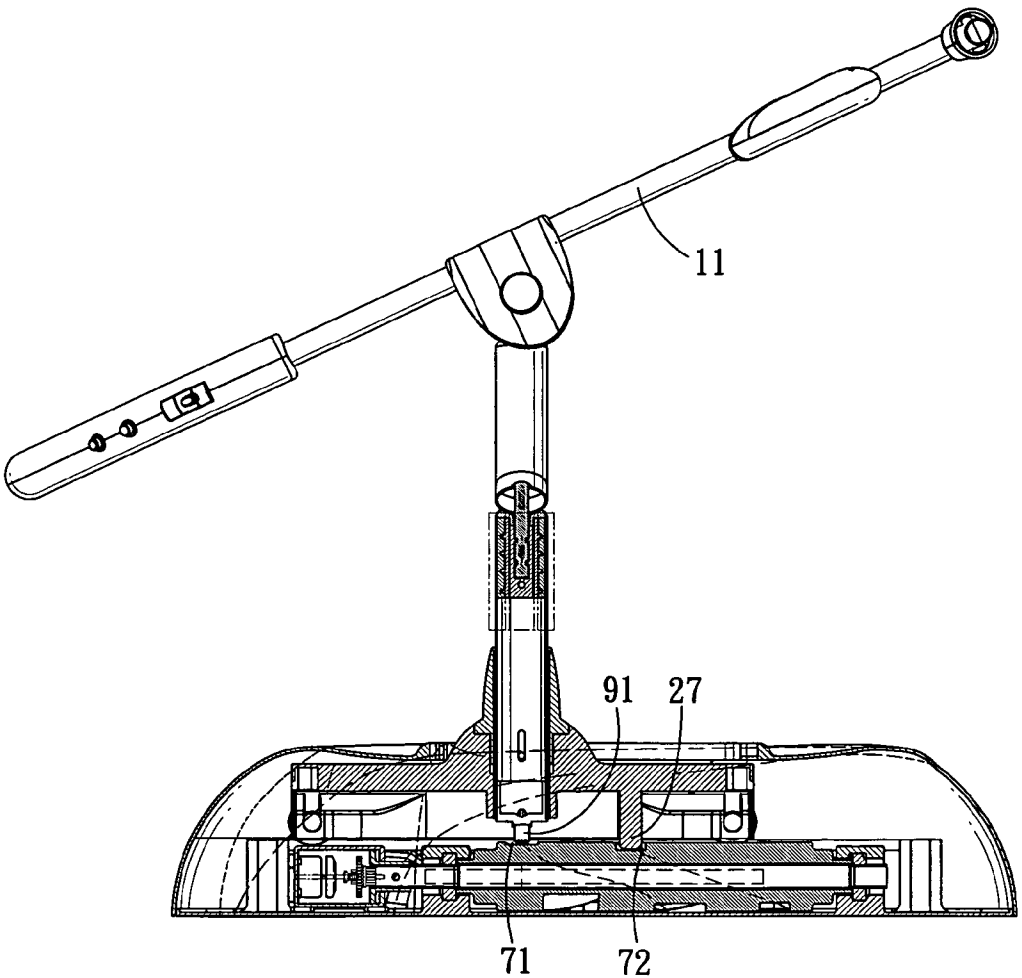

In an alternative design, the second helical slot 72 and the second projecting tooth 27 are omitted, and the shape of the first projecting tooth 91 is changed such that, when the supporting rod 3 is in the locked state, the first projecting tooth 91 is spaced apart from the bottom wall defining the first helical slot 71, and is in slidable contact with one of the lateral walls defining the first helical slot 71, thereby allowing the one of the lateral walls to perform the same function as the second helical slot 72 (see FIG. 7). That is, when the supporting rod 3 is in the locked state and when the power mechanism 6 is operated, the first projecting tooth 91 slides along the one of the lateral walls so as to allow for the back-and-forth motion of the seat body 11; and when the supporting rod 3 is in the released state and when the power mechanism 6 is operated, the first projecting tooth 91 slides along both the bottom wall and the one of the lateral walls so as to allow for the curved swinging motion of the seat body 11.

Figure 11:
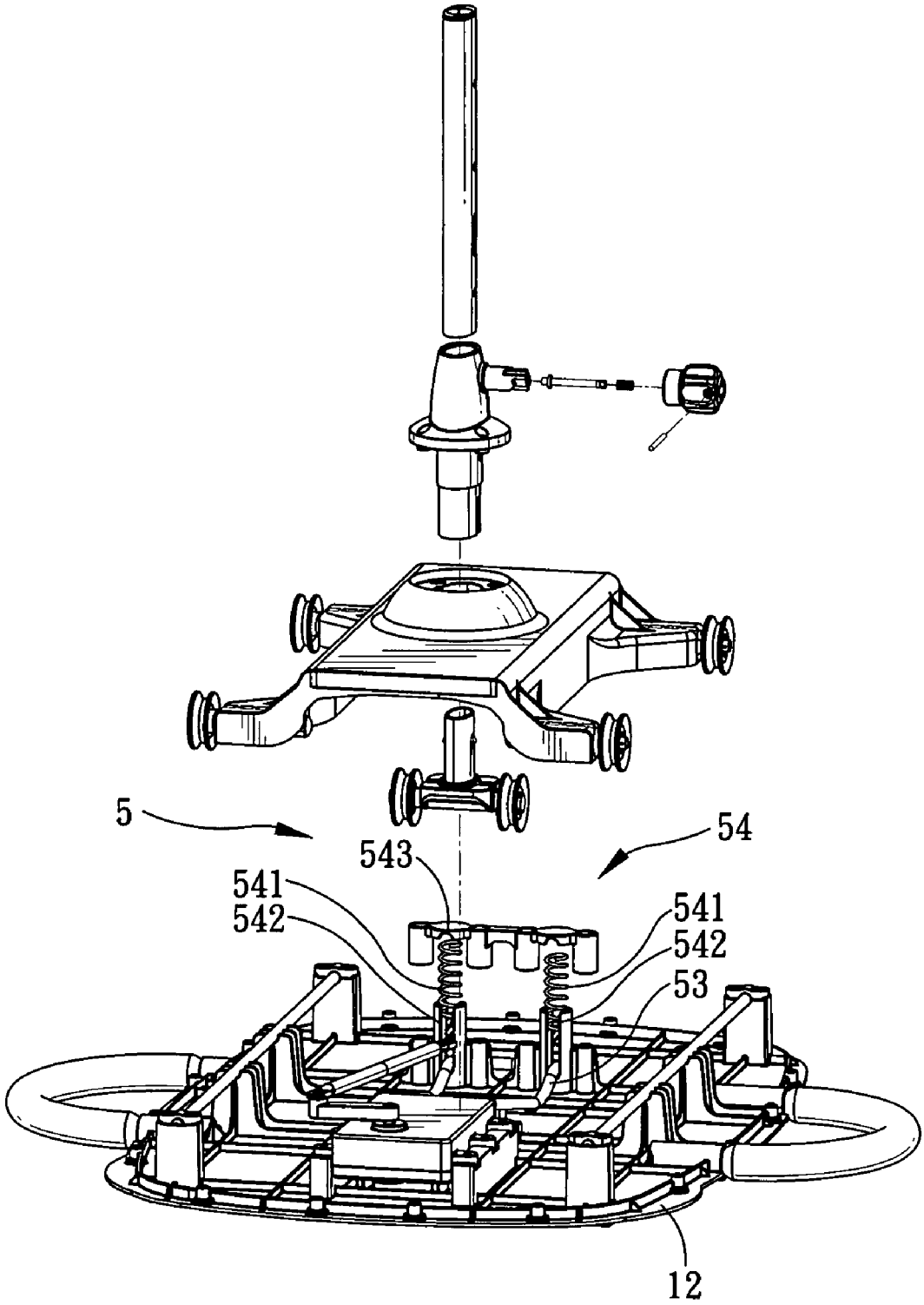
FIG. 11 is a partly exploded perspective view of the third preferred embodiment of a driving device for an infant rocking chair according to this invention.
Figure 12:
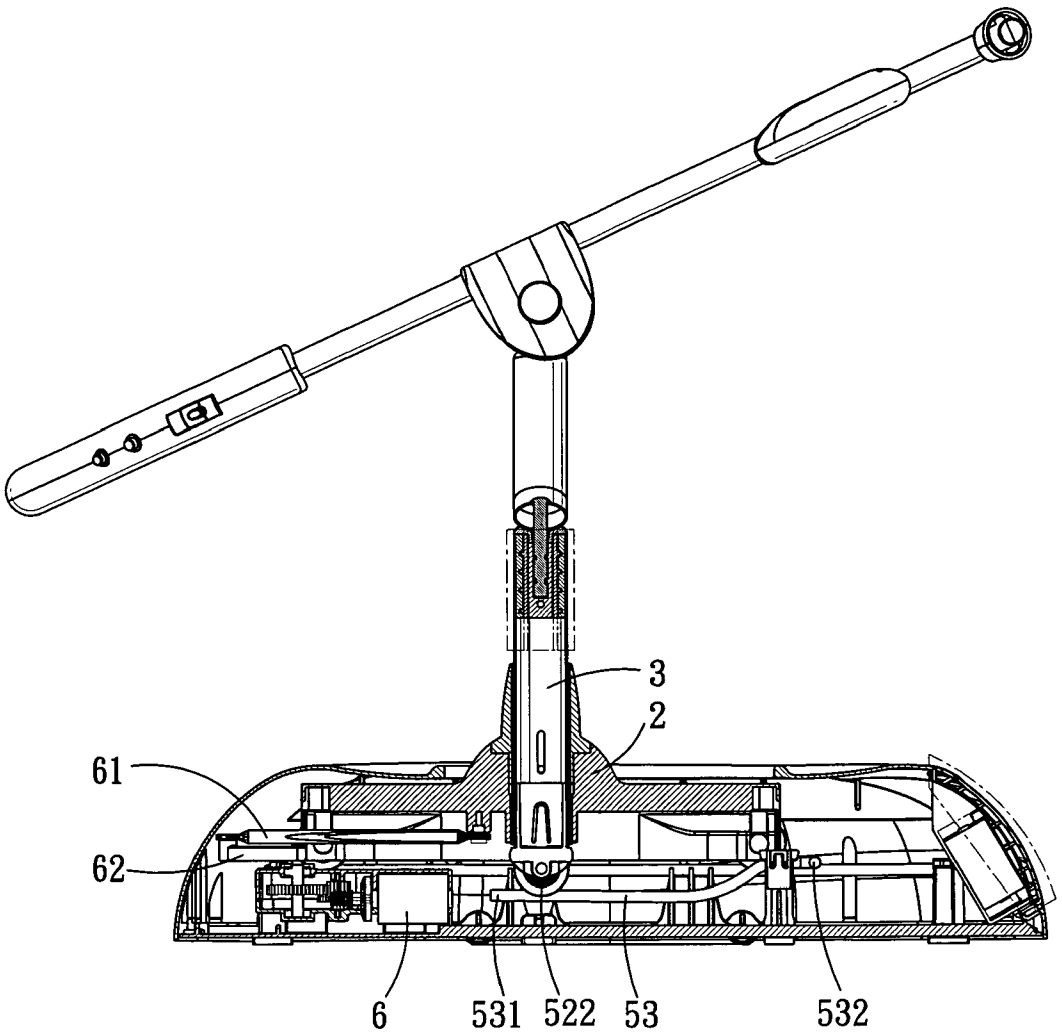
FIGS. 12, 13, 14, and 15 are schematic partly sectional views of the third preferred embodiment, illustrating the reciprocal movements of first and second motion mechanisms.
Figure 13:
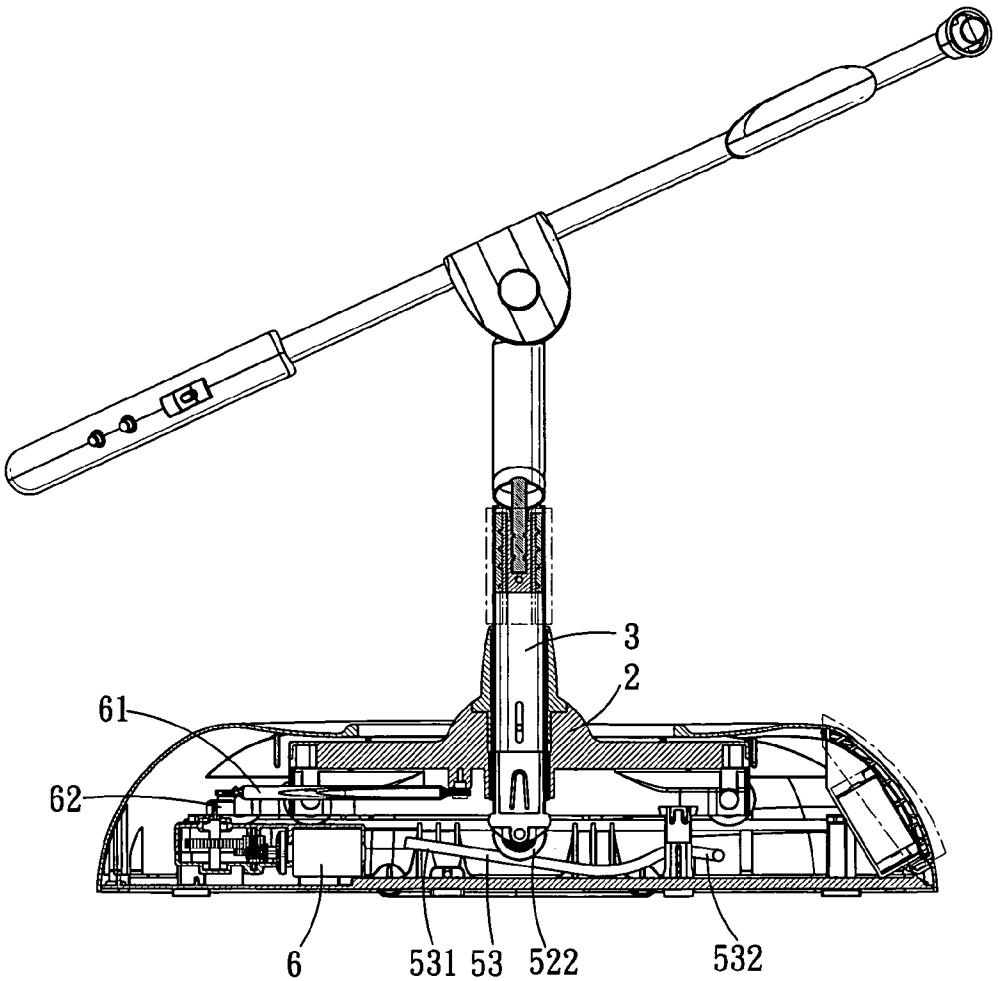
Figure 14:
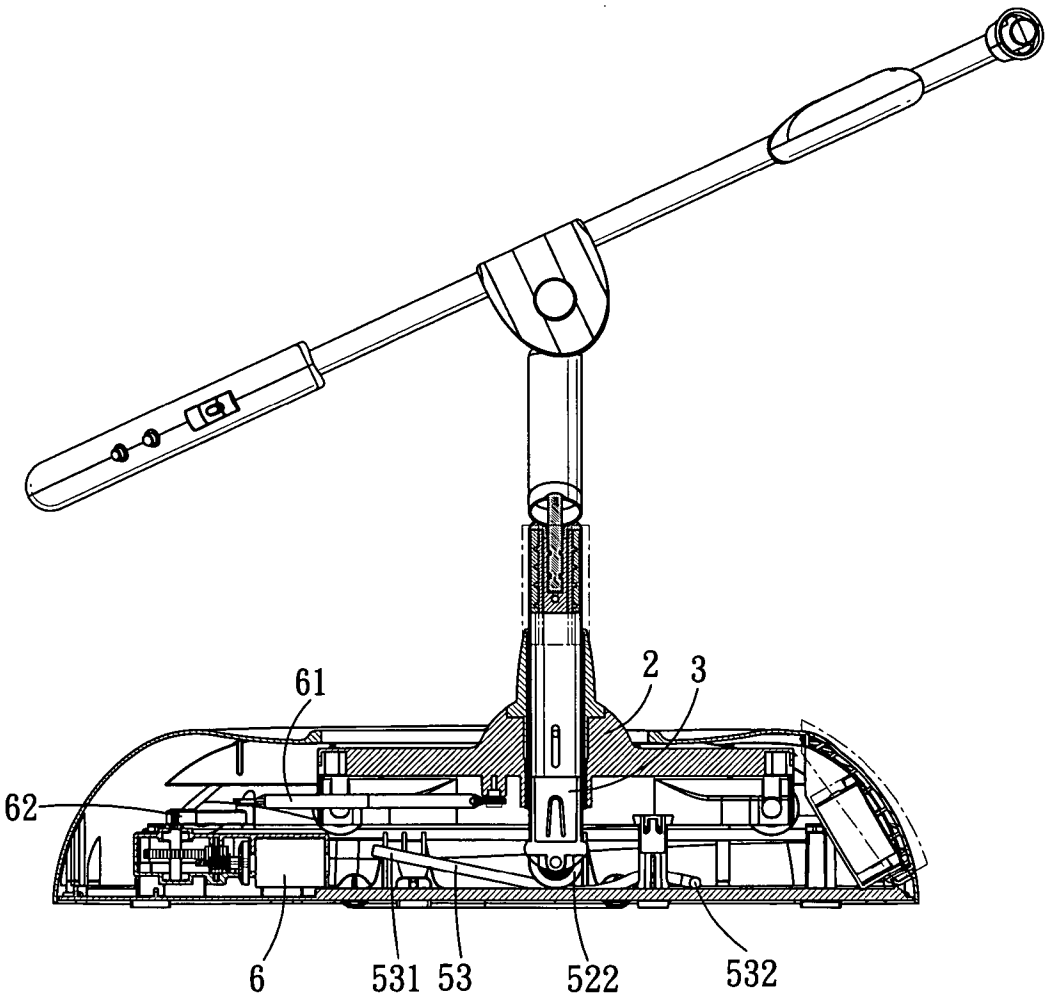
Figure 15:
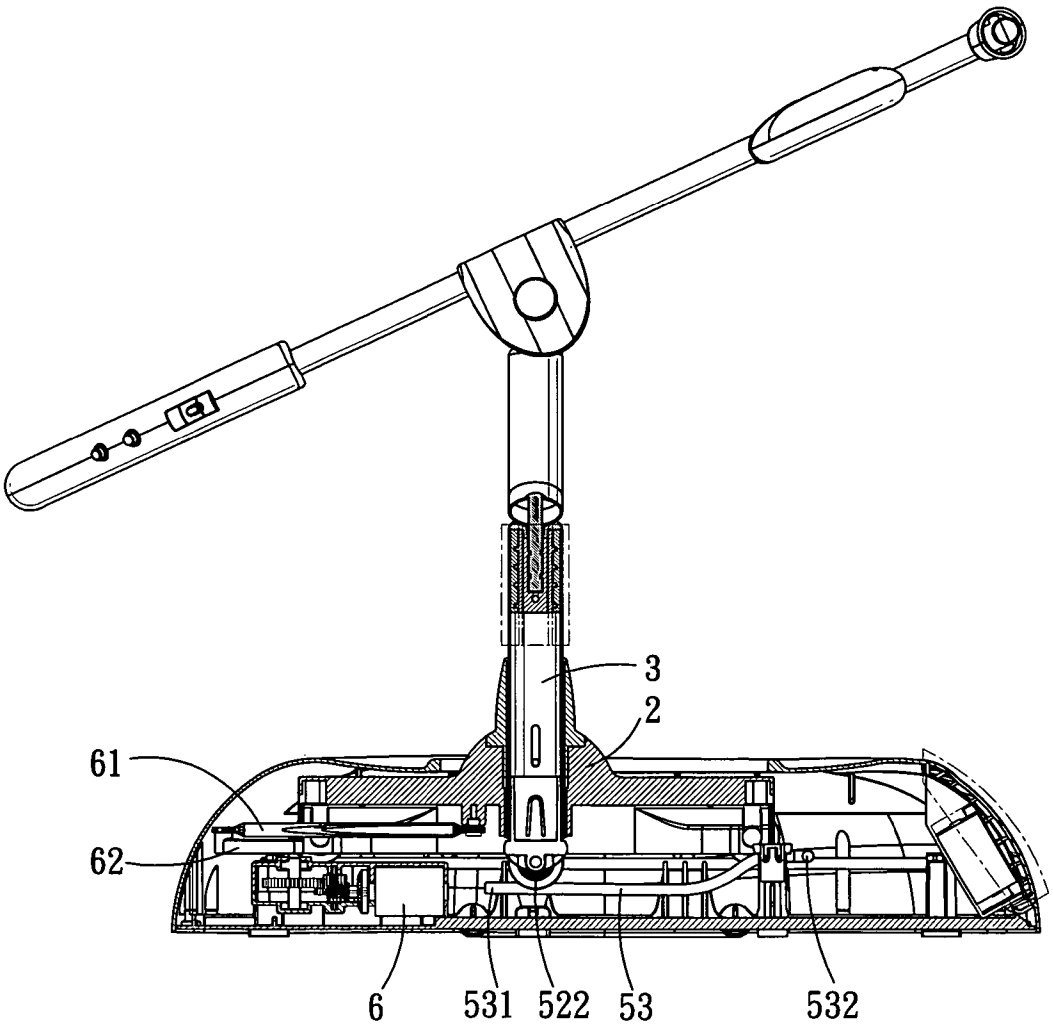

FIGS. 11 and 12 show the third preferred embodiment of a driving device for an infant rocking chair according to this invention, which is similar in construction to the first preferred embodiment. In this embodiment, the second motion mechanism 5 further includes a resilient damping unit 54, and each of the curved guiding rods 53 has a pivot end 531 connected pivotally to the bottom seat 12, and a free end 532 pivotable upwardly and downwardly about the pivot end 531. The resilient damping unit 54 includes two coiled compression springs 541, two spring-receiving members 542, and a spring-retaining member 543. The spring-receiving members 542 are disposed fixedly on the bottom seat 12 for receiving the springs 541, respectively. The spring-retaining member 543 is attached to the bottom seat 12 for preventing removal of the springs 542 from the spring-receiving members 542, respectively. The springs 541 are disposed between the bottom seat 12 and the free ends 532 of the curved guiding rods 53 for biasing the free ends 532 of the curved guiding rods 53 to pivot upwardly away from the bottom seat 12. With further reference to FIGS. 13, 14, and 15, when the second rollers 522 are moved from the pivot ends 531 toward the free ends 532, the springs 542 store return forces for biasing the free ends 532 to pivot upwardly when the second rollers 522 are moved from the free ends 532 toward the pivot ends 531. Thus, the output power that must be supplied by the motion mechanism 6 can be reduced.

With this invention thus explained, it is apparent that numerous modifications and variations can be made without departing from the scope and spirit of this invention. It is therefore intended that this invention be limited only as indicated by the appended claims.

We claim:

1. An infant rocking chair comprising:

a seat body;

a bottom seat;

a supporting element having a top end adapted to be connected to said seat body;

a base adapted to be disposed between said seat body and said bottom seat and including a mounting member permitting said supporting element to be mounted movably thereon, and a locking unit for locking said supporting element relative to said mounting member;

a first motion mechanism including a first guide path unit disposed at said bottom seat, and a first movable member disposed on said base and movable along said first guide path unit so that said seat body is movable relative to said bottom seat in a first direction;

a second motion mechanism including a second guide path unit disposed at said bottom seat, and a second movable member disposed fixedly on a bottom end of said supporting element and movable along said second guide path unit so that said seat body is movable relative to said base in a second direction different from said first direction; and a power mechanism for driving said base to reciprocate relative to said bottom seat along said first guide path unit in said first direction;

said supporting element and said locking unit being operable so as to convert said supporting element between a released state where said second movable member is in contact with said second guide path unit so as to allow said seat body to move relative to said base in said second direction when said base is moved relative to said bottom seat in said first direction, and a locked state where said second movable member is removed from said second guide path unit so as to allow said seat body to move relative to said bottom seat in only said first direction.

2. A driving device for an infant rocking chair, the infant rocking chair including a seat body and a bottom seat, said driving device being adapted to drive the seat body to reciprocate relative to the bottom seat back and forth as well as up and down, said driving device comprising:

a base adapted to be disposed between the seat body and the bottom seat;

a supporting element extending through and being movable vertically relative to said base and having a top end adapted to be connected to the seat body;

a first motion mechanism including a horizontal first guide path unit disposed at said bottom seat, and a first movable member disposed on said base and movable along said first guide path unit;

a second motion mechanism including a vertically varying second guide path unit disposed at said bottom seat, and a second movable member disposed fixedly on a bottom end of said supporting element and movable along said second guide path unit;

a power mechanism for driving said first movable member and, thus, said base to reciprocate back and forth along said first guide path unit and for driving said second movable member along said second guide path unit so as to allow said supporting element to reciprocate up and down relative to said base; and a threaded rod that is disposed between said bottom seat and said base and that is rotatable by said power mechanism, said threaded rod having an annular outer surface formed with an annular first helical slot that has a variable depth and that constitutes said second guide path unit, said second movable member being configured as a first projecting tooth extending from said bottom end of said supporting element into said first helical slot in said threaded rod.

3. The driving device as claimed in claim 2, wherein said annular outer surface of said threaded rod is further formed with an annular second helical slot having a uniform depth, said base being formed with a second projecting tooth that extends downwardly therefrom into said second helical slot in said threaded rod and that is movable along said second helical slot.

* * * * *